United States Patent [19]

Frain

[11] 4,165,878

[45] Aug. 28, 1979

[54] BINGO GAME AND PROCESS OF PLAYING SAME

[76] Inventor: John J. Frain, P.O. Box 2816, Clearwater, Fla. 33517

[21] Appl. No.: 900,479

[22] Filed: Apr. 27, 1978

[51] Int. Cl.[2] ..... A63F 3/06

[52] U.S. Cl. ..... 273/240; 273/269; 283/49

[58] Field of Search ..... 273/240, 269, 270; 283/49, 50, 66 A

[56] References Cited

U.S. PATENT DOCUMENTS

| | | | |
|---|---|---|---|
| 2,470,310 | 5/1949 | Heyman | 273/269 |
| 2,610,855 | 9/1952 | Spiller | 273/269 |
| 3,195,895 | 7/1965 | Kropinski | 273/240 |
| 3,665,618 | 5/1972 | Hahn | 273/270 |
| 3,909,001 | 9/1975 | Feldhausen | 273/270 |

*Primary Examiner*—Anton O. Oechsle

*Attorney, Agent, or Firm*—Watson, Cole, Grindle & Watson

[57] ABSTRACT

A game board and an insert sheet are utilized in playing the game of Bingo and the like, the board including a pair of interconnected spaced panels having an opening defining a pocket between the panels for reception of the insert sheet. One of the panels has Bingo numbers on its surface with window openings associated with the numbers. With the insert sheet in place, first portions on one surface thereof are exposed through each of the window openings so that, when game numbers are announced which coincide with those on the game board, such first portions of the insert sheet may be marked through the window openings so as to identify those coincident game numbers without actually disturbing the numbers on the game board. The game numbers are confined within spaces of a predetermined size on the game board so as to define rows lying parallel to the open side and centerlines of the spaces lying perpendicular to the open side. Window openings in alternate rows are respectively disposed on opposite sides of the centerlines so as to permit a plurality of games to be played using the one surface of the insert sheet as the sheet is shifted relative to the open side of the game board thereby incrementally exposing further unmarked portions of the one surface thereof. And, the insert sheet may be inserted in place with portions of its opposite surface exposed through the window openings and incrementally shifted as before.

37 Claims, 8 Drawing Figures

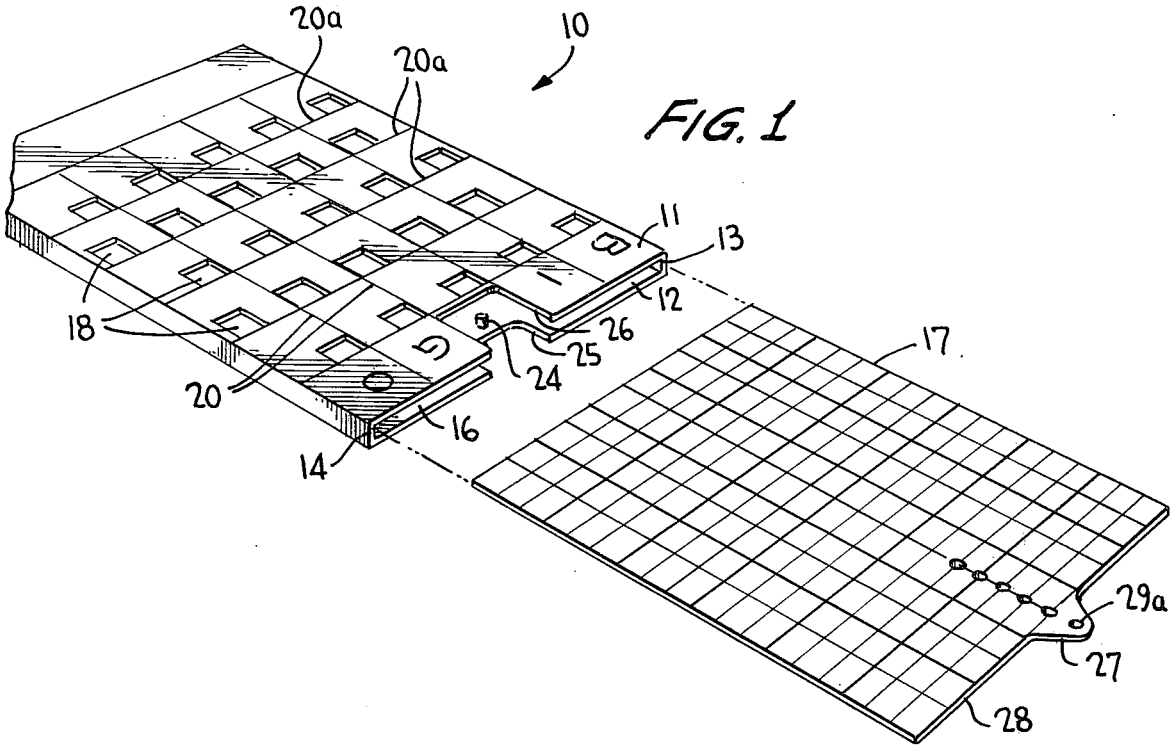
FIG. 1
FIG. 3
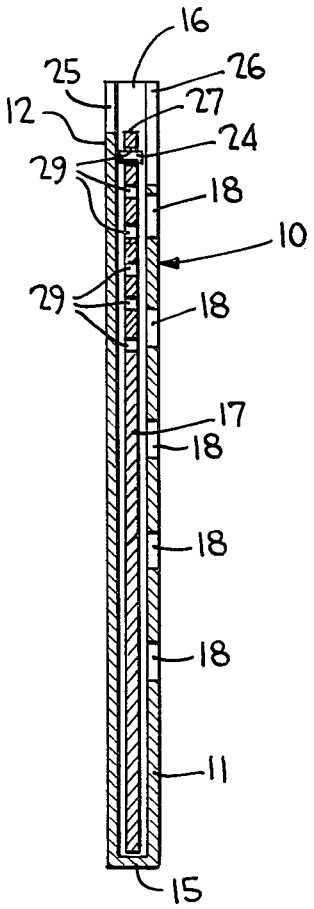
FIG. 2
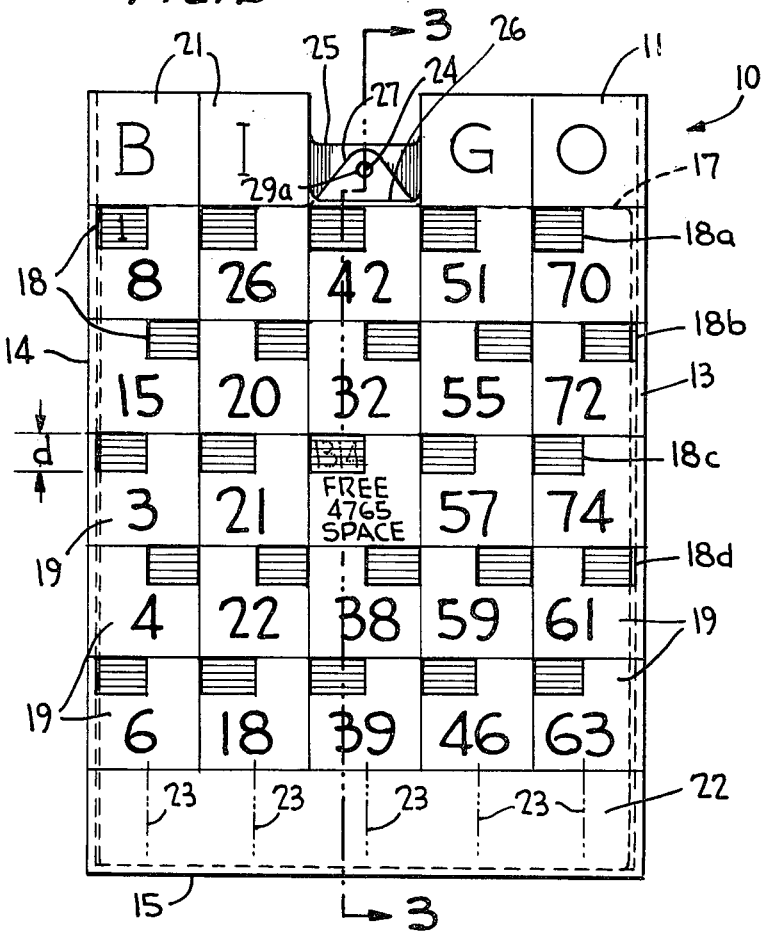

BINGO GAME AND PROCESS OF PLAYING SAME

BACKGROUND OF THE INVENTION

This invention relates generally to improvements for the playing of a Bingo game and the like, and more particularly to a game board containing an insert sheet to be marked through window openings associated with game numbers on the game board during the play of the game.

As is well known, the game of Bingo may be played with the use of "hard cards" sufficiently rigid to facilitate repeated use, the "hard cards" being printed with one or more sets of Bingo numbers which are cancelled with the use of corn kernels, chips or the like as they coincide with the Bingo numbers announced during the play of the game. Cancellation is also effected in prior art constructions with the use of shifting slides for covering the announced members.

Also, during the course of a Bingo playing session, "specials" are typically played with the use of "special" paper sheets imprinted with Bingo numbers and usable for a single play since the numbers coinciding with the announced numbers are normally cancelled by marking with a suitable marker. These "specials" are typically color coded to identify different Bingo "specials" played throughout the session. Also, they are identified with progressively different plate numbers during the printing thereof and, are further provided with serial numbers to render the Bingo "specials" as tamper-proof as possible. The numbering and serialization of these Bingo "specials" are generally set forth in the background discussion in U.S. Pat. No. 3,822,876, commonly owned herewith.

It can therefore be seen that much time and expense is involved in plate numbering and collating the Bingo "specials" and, since they can be used only once, a tremendous waste of material is involved. It would therefore be advantageous from a manufacturing, time and economy standpoint if the Bingo "specials" could be used for more than a single play, and if both the numbering and the collating of the Bingo "specials" as heretofore required could be eliminated.

OBJECTS OF THE INVENTION

It is therefore an object of the present invention to provide an improved device for effecting the play of a game of Bingo wherein "specials" are played similarly as in the past except that the numbering of the tickets is completely eliminated, collating is not required, and paper waste of the tickets is significantly reduced.

Another object of this invention is to provide such an improvement wherein a rigid game board has spaced panels interconnected along three sides and open at a fourth side so as to define a pocket for insertion of a sheet so that portions on a surface thereof are exposed through window openings provided in one of the panels of the game board having Bingo numbers normally arranged thereon and associated with such openings. Such exposed portions of the insert sheet may therefore be marked through the window openings lying adjacent the numbers on the game board which coincide with the announced Bingo numbers. The sheet may be likewise inserted in place with portions of its opposite surface exposed through the window openings for accepting markings as before. At least one play of the game may therefore be carried out using each surface of the insert sheet.

In accordance with a further object of the invention, the window openings and numbers are located in spaces forming rows parallel to the open side and having centerlines perpendicular to such open side, with the window openings in alternate rows lying respectively on opposite sides of the centerlines, so that the insert sheet may be shifted to expose second unmarked portions of its one surface through the window openings during a second play of the game whereby at least four plays may be carried out using a single insert sheet.

A still further object of this invention is to provide such an improvement wherein each window opening has a depth equal to one-third that of the spaces so as to permit the insert sheet to be incrementally shifted six times for respectively exposing unmarked portions on each surface thereof through the window openings, thereby permitting one insert sheet to be used for twelve plays of the game.

A still further object of this invention is to provide such an improvement wherein holes are located in the insert sheet along a line perpendicular to the open side of the game board, the number of holes equalling the number of shifts permitted for the insert sheet and being spaced apart a distance equal to the depth of the window openings, to thereby positively maintain the insert in place when shifted as a selected hole engages a peg provided on one of the two game board panels.

Other objects, advantages and novel features of the invention will become more apparent from the following detailed description of the invention when taken in conjunction with the accompanying drawings.

BRIEF DESCRIPTION OF THE DRAWINGS

FIG. 1 is a perspective view of the game board and insert sheet constructed according to the invention;

FIG. 2 is a top plan view of the game board of FIG. 1, shown in an upright position, with the insert sheet in place therein;

FIG. 3 is a vertical sectional view taken substantially along line 3—3 of FIG. 2;

DETAILED DESCRIPTION OF THE INVENTION

Figure 4:
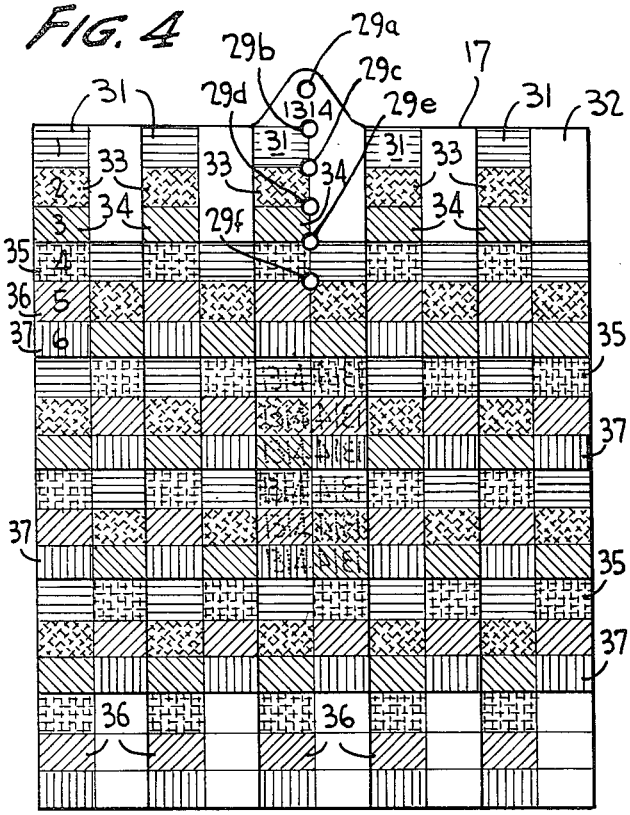
FIGS. 4 and 5 are respectively front and back plan views of the insert sheet.

Turning now to the drawings wherein like reference characters refer to like and corresponding parts throughout the several views, a game board of standard size adapted to be played on a table top is generally designated 10 in FIGS. 1 to 3 and comprises front and back panels 11 and 12 of sufficiently rigid material such as cardboard, plastic or the like, so as to be usable throughout an extended period of time without the need for replacement. The front and back panels are substantially rectangular in configuration and are interconnected along three sides by walls 13, 14 and 15. The panels are slightly spaced apart and are open at a fourth side as at 16 thereby defining a pocket for the reception of an insert sheet 17.

Front panel 11 is provided with a plurality of window openings 18 which may be of substantially rectangular configuration of the same size, and Bingo numbers such as shown in FIG. 2 are applied in any normal manner to the outer surface of panel 11. As typically provided on a standard Bingo card or sheet, the Bingo numbers are located in adjacent spaces 19 arranged in horizontal rows which, according to the invention, are parallel to open side 16, and are arranged in columns which are perpendicular to the open side of the game board. Space 19 at the center of the board is a free space and is designated as such together with a plate number such as 4765 for identification purposes. The spaces are defined by a set of spaced parallel lines 20 and intersecting a set of spaced parallel lines 20*a*. Spaces 21 at the top of panel 11 are reserved to identify the name of the game, such as BINGO (minus the N in this case), and space 22 at the bottom of panel 11 extending between walls 13 and 14 is reserved for identifying the name of the organization conducting the game and/or the manufacturer, if desired.

The size of the window openings is approximately one-sixth the size of spaces 19, and windows 18*a*, 18*c* and 18*e* lie to the left sides (as viewed in FIG. 2) of centerlines 23 in the first, third and fifth rows, while window openings 18*b* and 18*d* lie to the right of centerlines 23 in the remaining alternate rows. Also, the window openings each have the same depth d and are located at the topmost portions of their respective spaces.

A small peg 24 is provided on back panel 12 and extends toward front panel 11 but just short thereof, and panels 12 and 11 are respectively provided with slots 25 and 26 opening into open side 16. However, slot 26 is slightly deeper than slot 25 for exposing peg 24.

Insert sheet 17 is also substantially rectangular in configuration and is of a size capable of fitting without interruption within the pocket defined between panels 11 and 12, and is further substantially equal to the total size of all the spaces 19 and 22. A tab 27 extends outwardly of upper edge 28 of the insert, and a plurality of holes 29 are provided in the insert sheet along a line substantially perpendicular to edge 28 and to open side 16. The holes are equally spaced apart a distance equal to the depth d of the window openings, and are so disposed that the topmost opening 29*a* lies outwardly of edge 28 a distance equal to depth d.

In the position shown in FIGS. 2 and 3, with the insert disposed in a first position between panels 11 and 12, hole 29*a* engages peg 24 so as to be positively maintained in this position. Also, first portions 31 on a surface 32 of the insert sheet (FIG. 4), are exposed through each of the window openings. At least one of these portions is designated by the numeral "1" so as to identify the first of a number of "specials" to be played during a particular session. This numeral is, of course, exposed through one of the window openings as shown in FIG. 2, and each of the portions 31 may be color coded with a shading of blue, for example, to further identify the first of several Bingo game "specials".

Then, as the game is played and various letter and number combinations, such as B1, G55, O61, etc., are called by the game operator as during the standard play of Bingo, those portions 31 of the insert sheet exposed through the window openings lying in the spaces containing these numbers are marked through their window openings with a suitable marker so as to identify the associated Bingo numbers called. Such board numbers are otherwise not marked or otherwise cancelled in any manner as would typically be required if a Bingo game were being played using a standard "hard card."

At the end of play No. 1, tab 27 of the insert sheet is grasped for shifting the insert sheet an extent relative to open side 16 and equal to spacing d so as to cause second portions 33 on surface 32 of the insert sheet to now be exposed through the window openings in a second position of the insert which is maintained in such position as hole 29*b* engages peg 24. At least one of the portions 33 is identified by a numeral "2", and all of these portions may be color coded by a light shading of the color orange, for example. Play No. 2 of the Bingo "special" game is carried out similarly as described for play No. 1, and "special" games 3, 4, 5 and 6 may be carried out as the insert sheet is incrementally shifted relative to side opening 16 a distance equal to d, so as to respectively expose third, fourth, fifth and sixth portions 34 to 37 of surface 32 of the insert sheet through the window openings. At least one of each of these portions is respectively identified with numerals "3", "4", "5" and "6", and the portions may be respectively color coded with light shadings of green, yellow, brown and red, for example. Holes 29*c*, 29*d*, 29*e* and 29*f*, respectively engage peg 24 for retaining the insert sheet in its third, fourth, fifth and sixth positions when respective portions 34, 35, 36 and 37 thereof are exposed through the window openings.

Figure 5:
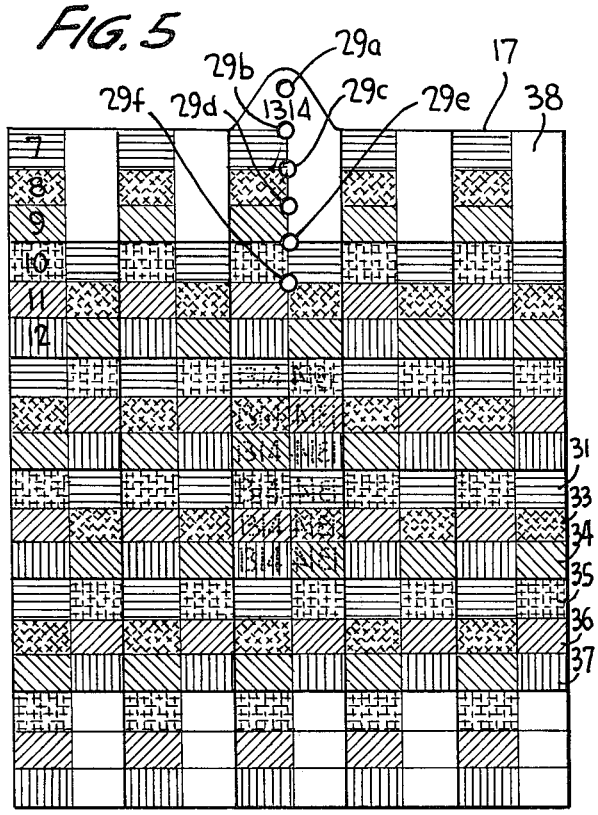

As seen in FIGS. 4 and 5, a serial number, such as 1314, is printed on both sides of tab 27, and the same serial number is printed by perforating through a stack of insert sheets 17 so as to overlie adjacent portions 31 and 33 to 37 substantially at the center of the insert and in vertical alignment so that a perforated serial number is always exposed through the "free space" window opening in all six positions of the insert, as typically shown in FIG. 2 for the first position. Hence, the insert sheet is rendered substantially tamper-proof and avoids unauthorized duplication by the application of both ink printed and perforated printed serial numbers thereon.

After the play of six "specials" using surface 32, the insert sheet may be removed from the game board, reversed and reinserted between panels 11 and 12 so that its opposite surface 38 faces upwardly. Thus, first portions 31 thereon are exposed through each of the window openings in a first position of the insert sheet while it is maintained in such position as hole 29*a* engages peg 24, similarly as described above. A seventh "special" may be played similarly as the first "special" aforedescribed, as the Bingo numbers which are announced are identified on the game board by marking these first portions 31 on surface 38 through the appropriate window openings. Second through sixth portions 32 to 36 are respectively exposed through the window openings upon subsequent incremental shifting of the insert sheet equal to spacing d into positions two through six during the play of "specials" 7 through 12 so as to respectively expose these portions of surface 38 through the window openings, similarly as described with reference to FIG. 4. The insert sheet is maintained in its positions two through six, when surface 38 is upright, through engagement between a selected one of openings 29*b* through 29*f* with peg 24. And, the serial number is applied by perforating, onto portions 31 and 32 to 36 at the center of the insert in vertical alignment so as to be respectively exposed through the "free space" each time the associated portions on surface 38 are exposed through the window openings. At least one of each of the six portions on surface 38 of the insert is respectively identified by numerals 7 through 12, and such portions may be respectively color coded with the same color shadings as described for those like portions on surface 32.

Figure 6:
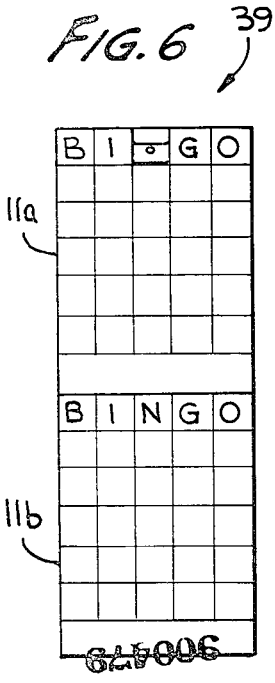
FIGS. 6, 7 and 8 are top plan views, at a slightly reduced scale, of double, triple and quadruple game boards, respectively, provided according to the invention.

To facilitate the play of more than one "special" at a time, double, triple and quadruple game boards may be provided. Thus, a double game board 39 is shown in FIG. 6 and is constructed the same as game board 10 except that front and back panels 11 and 12 are of double the length as shown in FIG. 2, and side walls 13 and 14 interconnect the sides of the panels throughout their length while bottom wall 15 interconnects the panels at the bottom of game board 39. Different sets of Bingo numbers are applied to the outer surface of sections 11*a* and 11*b* of the game board, and the pocket between the panels is open from top-to-bottom so as to accommodate an insert sheet of double length. Such a double insert sheet has a single set of holes 29*a* to 29*f*, as shown in FIGS. 4 and 5, but is of double length compared to that shown in these Figures with surfaces 32 and 38 repeated on respective sides. Hence, two first portions 31 on surface 32 are exposed through the window openings in panel sections 11*a* and 11*b* in a first position of the insert, with at least one of each such portions being identified by the numeral "1". And, the two sets of such portions 31 may be color coded with a blue shading.

Figure 7:
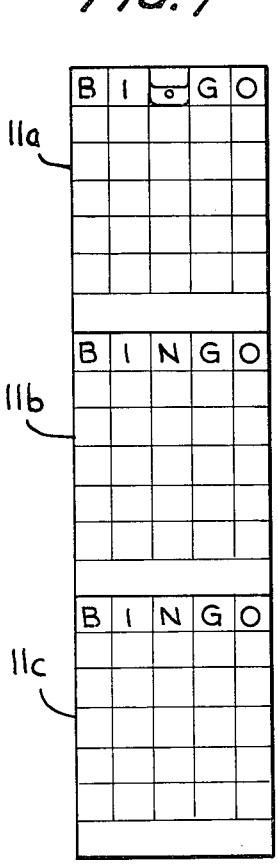

The triple game board 41 is shown in FIG. 7 as comprising triple depth outer panels with the front panel having three sets of window openings and three different sets of Bingo numbers in sections 11*a*, 11*b* and 11*c*, the panels being interconnected at their sides and bottom so as to define a pocket opening at the top for the insertion of a triple depth insert sheet having both surfaces thereof repeated three times compared to that illustrated in FIGS. 4 and 5.

Figure 8:
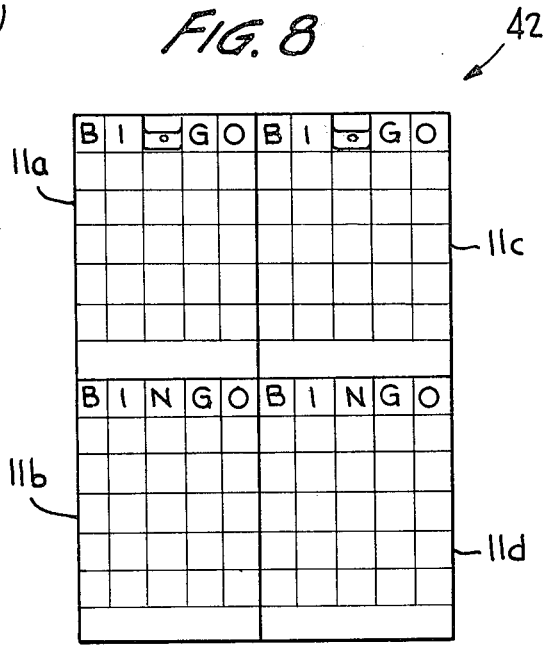

The double game board as shown in FIG. 6 may be made two-wide into a game board 42 shown in FIG. 8 for the play of four "specials" at one time using two double length insert sheets. Four different sets of Bingo numbers are applied in sections 11*a*, 11*b*, 11*c* and 11*d*. The play using the aforedescribed double, triple and quadruple game boards is exactly the same as that described above with reference to the single game board.

From the foregoing it can be seen that as many as twelve Bingo "specials" may be played using a single insert sheet thereby significantly reducing the amount of paper used as compared to that required for the play of Bingo "specials" as presently known. A single insert sheet according to the invention replaces up to twelve Bingo "special" tickets heretofore used of substantially the same size thereby obviously saving in material, printing and labor costs. The portions which are exposed in the six relative positions on surface 32 and in the six relative positions on surface 38 may be color coded similarly as is typical for Bingo "special" tickets now used to identify the various special plays throughout the session. The insert sheets may be printed with numbers 1 to 12 as aforedescribed for use by those players wishing to play twelve "specials", or they may be printed with fewer numbers for those wishing to play less than all the "specials" to be offered during the playing session.

The game identifying numbers 1 to 12 and the serial numbers applied by perforating may be respectively transposed from that shown in FIGS. 4 and 5 of the drawings, without departing from the invention. And, the insert sheet need not be color coded to carry out the invention.

Although the present invention has been described with reference to the game of Bingo, it should be understood that other games such as Lotto, Beano and any other form of five-letter words using Bingo as a base, may be played instead. And, game board 10 of the invention may be used alone, if desired, during the play of the game similarly as a "hard card" with the use of chips or the like for cancelling the announced Bingo numbers.

Obviously, many other modifications and variations of the present invention are made possible in the light of the above teachings. It is therefore to be understood that within the scope of the appended claims, the invention may be practiced otherwise than as specifically described.

I claim:

1. A game board for the play of a game such as Bingo, comprising, front and back superimposed panels of rectangular configuration being spaced apart and interconnected along three sides to form a pocket open at a fourth side thereof for the reception of an insert sheet between said panels, a plurality of spaced and parallel first lines and a plurality of spaced and parallel second lines disposed on an outer surface of said front panel, said first and second lines intersecting at right angles so as to define a plurality of spaces each having a predetermined size, a plurality of window openings in only said front panel located in each of said spaces and being of a size less than said predetermined size for exposing portions of the insert sheet therethrough, and a plurality of characters disposed on said outer surface in said spaces adjacent said window openings for facilitating the play of the game, whereby said characters may be cancelled during the play of the game as the sheet is marked through said adjacent window openings.

2. The board according to claim 1, wherein at least one of said panels has means thereon for retaining the insert sheet in place between said panels.

3. The board according to claim 2, wherein said means comprises a peg on an inner surface of said one panel extending toward the other of said panels for engagement with an opening provided in the insert sheet, said peg being located adjacent said fourth side.

4. The board according to claim 3, wherein said panels are provided with notches opening into said fourth side, one of said notches exposing said peg.

5. The board according to claim 1, wherein said spaces are disposed in adjacent rows parallel to said fourth side, said window openings being disposed in alternate ones of said rows in a first position in said spaces and in the remaining ones of said rows in a second position in said spaces, centerlines of said spaces lying perpendicular to said fourth side, said window openings in said first position respectively lying on one side of said centerlines, and said window openings in said second position respectively lying on a side of said centerlines opposite said one side.

6. The board according to claim 5, wherein said fourth side constitutes an upper side of said game board, said window openings in said first and second positions respectively lying uppermost in said spaces and occupying approximately one-third said spaces respectively on said sides of said centerlines.

7. A combination game board and insert sheet for the play of a game such as Bingo, the game board comprising front and back superimposed panels of rectangular configuration being spaced apart and interconnected along three sides to form a pocket at a fourth side thereof for the reception of the insert sheet between said panels, a plurality of spaced and parallel first lines and a plurality of spaced and parallel second lines disposed on an outer surface of said front panel, said first and second lines intersecting at right angles so as to define a plurality of spaces each having a predetermined size, a plurality of window openings in only said front panel located in each of said spaces and being of a size less than said predetermined size for exposing first portions through said window openings on at least one surface of said insert sheet when in a first position relative to said panels, and a plurality of characters disposed on said outer surface in said spaces adjacent said window openings for facilitating the play of the game, whereby said characters may be cancelled during the play of the game as said first portions of said sheet are marked through said adjacent window openings.

8. The combination according to claim 7, wherein at least one of said panels has means thereon for retaining the insert sheet in place between said panels.

9. The combination according to claim 8, wherein said insert sheet is provided with at least one hole therein, and said means comprises a peg on an inner surface of said one panel extending toward the other of said panels for engagement with said hole to retain said insert sheet in said first position, said peg being located adjacent said fourth side.

10. The combination according to claim 9, wherein panels are provided with notches opening into said fourth side, one of said notches exposing said peg.

11. The combination according to claim 7, wherein said spaces are disposed in adjacent rows parallel to said fourth side, said window openings being disposed in alternate ones of said rows in a first position in said spaces and in the remaining ones of said rows in a second position in said spaces, centerlines of said spaces lying perpendicular to said fourth side, said window openings in said first position respectively lying on one side of said centerlines, and said window openings in said second position respectively lying on a side of said centerlines opposite said one side.

12. The combination according to claim 11, wherein said fourth side constitutes an upper side of said game board, said window openings in said first and second positions respectively lying uppermost in said spaces and occupying approximately one-third said spaces respectively on said sides of said centerlines.

13. The combination according to claim 11, wherein said insert sheet may lie between said panels in a second position relative to said first position for exposing second portions on said one surface thereof through said window openings, whereby said characters may be cancelled during the play of another game as said second portions are marked through said adjacent window openings.

14. The combination according to claim 12, wherein said insert sheet may lie between said panels in second, third, fourth, fifth and sixth positions relative to said first position for exposing corresponding second, third, fourth, fifth and sixth portions on said one surface thereof through said window openings, whereby said characters may be cancelled during the play of up to six games as said respective portions are marked through said adjacent window openings.

15. The combination according to claim 13, wherein a second hole is provided in said insert sheet engageable with said peg for retaining said insert sheet in said second position.

16. The combination according to claim 14, wherein six holes are provided in said insert sheet and are respectively engageable with said peg for retaining said insert sheet in said first, second, third, fourth, fifth and sixth positions, respectively.

17. The combination according to claim 7, wherein said insert sheet is disposed between said panels so that first portions on a surface thereof opposite said one surface are exposed through said window openings when said insert sheet is in said first position relative to said panels.

18. The combination according to claim 9, wherein said insert sheet is disposed between said panels so that first portions on a surface thereof opposite said one surface are exposed through said window openings when said insert sheet is in said first position relative to said panels, said sheet being retained in said first position upon engagement between said one hole and said peg.

19. The combination according to claim 13, wherein said insert sheet is disposed between said panels so that second portions on a surface thereof opposite said one surface are exposed through said window openings when said insert sheet is in said second position relative to said panels.

20. An insert sheet for multiple use in the play of a game, such as Bingo, from a game board having a plurality of game characters on an outer surface thereof and window openings associated with said characters, the insert sheet being substantially rectangular and being divided on one surface thereof into a plurality of rows of a predetermined depth lying parallel to one edge of the insert and into intersecting columns perpendicular to said one edge for defining a plurality of blocks of the same size, a first set of said blocks being located in alternate ones of said columns at a plurality of first rows and in the remaining ones of said columns at a plurality of second rows, a second set of said blocks being located in said alternate columns at a plurality of third rows respectively adjacent said first rows and in said remaining columns at a plurality of fourth rows respectively adjacent said second rows, first identifying means on at least one of said first blocks and second identifying means different from said first means on at least one of said second blocks, at least two holes in said sheet aligned parallel to said columns and being spaced apart a distance equal to said depth of said rows, and identification serial numbers applied to said one surface on at least one of said first and one of said second sets of blocks.

21. The sheet according to claim 20, wherein a third set of said blocks are located in said alternate columns at a plurality of fifth rows respectively adjacent said third rows and in said remaining columns at a plurality of sixth rows respectively adjacent said fourth rows, third identifying means on at least one of said third blocks different from said first and second identifying means, at least three holes in said sheet aligned parallel to said columns and being spaced apart from one another a distance equal to said depth of said rows, and said serial numbers being also applied to said one surface on at least one of said third blocks.

22. The sheet according to claim 21, wherein a fourth set of said blocks are located in said alternate columns at said second rows and in said remaining columns at said first rows, fourth identifying means on at least one of said fourth blocks different from said first, second and third identifying means, at least four holes in said sheet aligned parallel to said columns and being spaced apart from one another a distance equal to said depth of said rows, and said serial numbers being also applied to said one surface on at least one of said fourth blocks.

23. The sheet according to claim 22, wherein a fifth set of said blocks are located in said alternate columns at said fourth rows and in said remaining columns at said third rows, fifth identifying means on at least one of said fifth blocks different from said first, second, third and fourth identifying means, at least five holes in said sheet aligned parallel to said columns and being spaced apart from one another a distance equal to said depth of said rows, and said serial numbers being also applied to said one surface on at least one of said fifth blocks.

24. The sheet according to claim 23, wherein a sixth set of said blocks are located in said alternate columns at said sixth rows and in said remaining columns at said fifth rows, sixth identifying means on at least one of said sixth blocks different from said first, second, third, fourth and fifth identifying means, six holes in said sheet aligned parallel to said columns and being spaced apart from one another a distance equal to said depth of said rows, and said serial numbers being also applied to said one surface on at least one of said sixth blocks.

25. The sheet according to claim 24, wherein said first, second, third, fourth, fifth and sixth identifying means respectively comprise different numerals identifying different plays of the game.

26. The sheet according to claim 24, wherein said first, second, third, fourth, fifth and sixth identifying means are applied to each of said first, second, third, fourth, fifth and sixth blocks, respectively, and comprise first, second, third, fourth, fifth and sixth different and unlike colors, respectively.

27. The sheet according to claim 24, wherein a tab extends outwardly of said one edge, and a first of said holes lying in said tab.

28. A process for playing a board game, such as Bingo, comprising the steps of:

providing a game board having spaced panels of substantially rectangular configuration, said panels being interconnected along three sides and being open along a fourth side so as to define a pocket;

providing a plurality of window openings in one of said panels;

providing a plurality of game characters on an outer surface of said one panel respectively adjacent each of said window openings with the exception of a free space located at the center of said outer surface;

disposing an insert sheet between said panels through said open fourth side so that first portions of one surface of said sheet are exposed through each of said window openings in a first position between said panels; and marking said first portions of the insert sheet through said window openings when said adjacent characters are announced during the play of a first game;

whereby at least one board game may be played with the use of said insert sheet without disturbing said game characters on said outer surface.

29. The process according to claim 28, including the further steps of confining said game characters within adjacent spaces of a predetermined size on said outer surface within rows lying parallel to said fourth side and within columns having centerlines lying perpendicular to said fourth side, locating said windows in alternate rows respectively on opposite sides of said centerlines, confining said game characters within remaining portions of said spaces, shifting said insert sheet into a second position relative to said open fourth side so as to expose second unmarked portions thereof through said window openings, and marking said second portions through said window openings when said adjacent characters are announced during the play of a second game, whereby at least two board games may be played with the use of said insert sheet.

30. The process according to claim 28, including the further step of positively maintaining said insert sheet between said panels in said first position.

31. The process according to claim 29, including the further step of positively maintaining said insert sheet between said panels in said second position.

32. The process according to claim 29, wherein said window openings have a size one-sixth said predetermined size of said spaces, respectively, further shifting said insert sheet incrementally relative to said open fourth side so as to expose third, fourth, fifth and sixth unmarked portions thereof through said window openings, and marking said third, fourth, fifth, and sixth portions when said adjacent characters are announced during the play of third, fourth, fifth and sixth games, respectively, whereby six board games may be played using said one surface of said insert sheet.

33. The process according to claim 32, including the further steps of providing a peg on a first of said panels adjacent said fourth side, and providing six holes in said insert sheet along a line perpendicular to said fourth side for maintaining said sheet in said first, second, third, fourth and fifth positions upon respective engagement between said holes and said peg, said holes being spaced apart a distance equal to the depth of said window openings.

34. The process according to claim 28, including the further steps of disposing said insert sheet between said panels through said open fourth side so that first portions of a surface thereof opposite said one surface are exposed through each of said window openings in said first position between said panels, marking said first portions of said opposite surface through said window openings when said adjacent characters are announced during the play of another game, whereby at least two board games may be played using said surfaces of said insert sheet.

35. The process according to claim 29, including the further steps of disposing said insert sheet between said panels through said open fourth side so that first portions of a surface thereof opposite said one surface are exposed through each of said window openings in said first position between said panels, marking said first portions of said opposite surface through said window openings when said adjacent characters are announced during the play of another game, shifting said insert sheet into said second position relative to said fourth side so as to expose second unmarked portions of said opposite surface through said openings, and marking said second portions of said opposite surface when said adjacent characters are announced during the play of another game, whereby at least four games may be played using said surfaces of said insert sheet.

36. The process according to claim 35, wherein said window openings have a size one-sixth said predetermined size of said spaces, respectively, further shifting said insert sheet incrementally relative to said open fourth side so as to expose third, fourth, fifth and sixth unmarked portions thereof through said window openings, and marking said third, fourth, fifth and sixth portions when said adjacent characters are announced during the play of third, fourth, fifth and sixth games, respectively, whereby twelve board games may be played using said surfaces of said insert sheet.

37. The process according to claim 36, including the further steps of providing a peg on a first of said panels adjacent said fourth side, and providing six holes in said insert sheet along a line perpendicular to said fourth side for maintaining said sheet in said first, second, third, fourth and fifth positions upon respective engagement between said holes and said peg, said holes being spaced apart a distance equal to the depth of said window openings.

* * * * *